US010766724B2

(12) United States Patent
Tai

(10) Patent No.: US 10,766,724 B2
(45) Date of Patent: Sep. 8, 2020

(54) SHEET CONVEYANCE DEVICE AND IMAGE FORMING APPARATUS

(71) Applicant: KONICA MINOLTA, INC., Chiyoda-ku, Tokyo (JP)

(72) Inventor: Haruka Tai, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/902,331

(22) Filed: Feb. 22, 2018

(65) Prior Publication Data

US 2018/0284683 A1 Oct. 4, 2018

(30) Foreign Application Priority Data

Mar. 29, 2017 (JP) ..... 2017-065220

(51) Int. Cl.

*B65H 5/24* (2006.01)
*B65H 9/16* (2006.01)
*B65H 5/06* (2006.01)
*B65H 3/06* (2006.01)
(Continued)

(52) U.S. Cl.

CPC ..... *B65H 5/24* (2013.01); *B65H 3/06* (2013.01); *B65H 5/062* (2013.01); *B65H 9/166* (2013.01); *G03G 15/6564* (2013.01); *B65H 29/669* (2013.01); *B65H 2404/147* (2013.01); *B65H 2511/22* (2013.01); *B65H 2513/10* (2013.01); *B65H 2513/51* (2013.01);
(Continued)

(58) Field of Classification Search

CPC .. B65H 29/669; B65H 5/062; B65H 2403/11; B65H 2513/104
See application file for complete search history.

(56) References Cited

U.S. PATENT DOCUMENTS 4,461,465 A * 7/1984 Hartman, Jr. ..... B65H 3/46 271/121
6,533,263 B2 * 3/2003 Tamura ..... B65H 7/18 271/10.01
(Continued)

FOREIGN PATENT DOCUMENTS

JP 59182138 A * 10/1984 ..... B65H 7/12
JP 2003-176045 A 6/2003

*Primary Examiner* — Howard J Sanders
(74) *Attorney, Agent, or Firm* — Buchanan Ingersoll & Rooney PC

(57) ABSTRACT

A sheet conveyance device includes: a container that accommodates loaded sheets; a feeding mechanism that continuously feeds the sheet from the container; a conveyance path on which the sheet is conveyed; and a pitch adjustment mechanism provided on the conveyance path and which adjusts a pitch of a preceding sheet and a subsequent sheet, wherein the pitch adjustment mechanism includes a pitch adjustment roller pair including a first pitch adjustment roller and a second pitch adjustment roller that sandwich the conveyance path and are in pressure contact with each other, the first pitch adjustment roller is driven and rotated in a direction following a sheet conveying direction, the second pitch adjustment roller is driven and rotated in the direction following a sheet conveying direction, and the second pitch adjustment roller is connected to a drive shaft that drives the second pitch adjustment roller via a one-way clutch.

14 Claims, 7 Drawing Sheets

(51) Int. Cl.
*G03G 15/00* (2006.01)
*B65H 29/66* (2006.01)

(52) U.S. Cl.
CPC ..... *G03G 2215/004* (2013.01); *G03G 2215/00396* (2013.01); *G03G 2215/00565* (2013.01)

(56) References Cited

U.S. PATENT DOCUMENTS

2008/0272535 A1* 11/2008 Gustafsson ..... B65H 1/025 271/22
2015/0108706 A1* 4/2015 Watanabe ..... B65H 5/068 271/3.18

* cited by examiner

SHEET CONVEYANCE DEVICE AND IMAGE FORMING APPARATUS

The entire disclosure of Japanese patent Application No. 2017-065220, filed on Mar. 29, 2017, is incorporated herein by reference in its entirety.

BACKGROUND

Technological Field

The present invention relates to a sheet conveyance device that conveys a sheet and an image forming apparatus including the sheet conveyance device.

Description of the Related Art

In image forming apparatuses typified by copying machines, printers, and facsimiles, a sheet made of paper or the like as a recording material is conveyed by a sheet conveyance device provided in the image forming apparatuses.

At that time, a plurality of sheets loaded in a container such as a tray or a cassette is handled sheet by sheet by a feeding mechanism provided in the sheet conveyance device, and a preceding sheet and a subsequent sheet are often separated from each other and conveyed (that is, in a state where a gap having a predetermined size is formed between a tail end of the preceding sheet and a lead end of the subsequent sheet).

This is because variation is caused in the conveyance speed with respect to individual sheets due to various factors such as the configuration of the conveyance path on which the sheet is conveyed and states of the rollers constituting the conveyance path, and the sheets are prevented in advance from being sent to print processing in a state where the preceding sheet and the subsequent sheet partially overlap with each other.

In addition, in a resist roller pair that supplies the sheet to a printing section such as a transfer unit, skew correction for correcting the tilt of the sheet is typically performed. In that case, it is often configured to correct the tilt of the sheet by driving skew correction rollers in a state where the resist roller pair is stopped. In this case, a gap having a predetermined size needs to be formed between the tail end of the preceding sheet and the lead end of the subsequent sheet.

Here, a problem occurs, in which productivity in image formation (the productivity corresponds to image formation efficiency in tlc image forming apparatus and corresponds to sheet conveyance efficiency in the sheet conveyance device) is decreased if the gap becomes large. To prevent the problem, it is conceivable to increase a system speed (that is, an overall sheet conveyance speed in the sheet conveyance device).

However, if the system speed is increased, there is not only the problem of an increase in noise generated by a drive motor, rollers, and the like but also acceleration of consumption of various parts, resulting in an increase in tlc parts cost and the running cost.

To solve the problem. JP 2003-176045 A discloses a sheet conveyance device provided with a feeding mechanism capable of feeding sheets in a so-called continuous feed state in which no gap is formed between a tail end of a preceding sheet and a lead end of a subsequent sheet (that is, a state in which the tail end of the preceding sheet meets the lead end of the subsequent sheet), and which forms a gap having a predetermined size between the preceding sheet and the subsequent sheet by stopping conveyance of the subsequent sheet before the preceding sheet passes through a resist roller pair.

By adopting the sheet conveyance device of this configuration, the sheet is fed in the so-called continuous feed state, and thus the productivity can be improved by the continuous feed system without increasing the system speed.

However, in the case of the sheet conveyance device disclosed in JP 2003-176045 A, rollers need to be disconnected from a drive shaft by using a clutch or the like to stop conveyance of the subsequent sheet. In such a configuration, the rollers intermittently repeat rotation and stop.

If the rollers intermittently repeat rotation and stop, variation in the conveyance speed of the sheets is more likely to occur due to backlash of a gear connecting the rollers and the drive motor. To suppress the variation, a complicated control mechanism is separately required.

Therefore, in the case of adopting the configuration, the device configuration becomes complicated. As a result, a problem of an increase in the manufacturing cost occurs.

Further, in the case of adopting the sheet conveyance device disclosed in JP 2003-176045 A, the sheets are fed out in the so-called continuous feed state and thus the productivity is improved by the absence of the gap between the sheets, as compared with the case of feeding the preceding sheet and the subsequent sheet in a separated state. However, further improvement in the productivity cannot be expected, and the improvement of the productivity has limitations.

SUMMARY

Therefore, the present invention has been made in view of the above-described problems, and an object thereof is to provide a sheet conveyance device that can improve productivity without increasing a system speed with a simple configuration without requiring complicated control, and an image forming apparatus including the sheet conveyance device.

To achieve the abovementioned object, according to an aspect of the present invention, a sheet conveyance device reflecting one aspect of the present invention comprises: a container that accommodates a plurality of loaded sheets; a feeding mechanism that continuously feeds the sheet from the container; a conveyance path on which the sheet fed by the feeding mechanism is conveyed; and a pitch adjustment mechanism provided on the conveyance path and which adjusts a pitch of a preceding sheet and a subsequent sheet in an at least partially overlapping state, wherein the pitch adjustment mechanism includes a pitch adjustment roller pair including a first pitch adjustment roller and a second pitch adjustment roller that sandwich the conveyance path and are in pressure contact with each other, the first pitch adjustment roller is driven and rotated in a direction following a sheet conveying direction, the second pitch adjustment roller is driven and rotated in the direction following a sheet conveying direction such that a peripheral speed on an outer peripheral surface of the second pitch adjustment roller becomes slower than a peripheral speed on an outer peripheral surface of the first pitch adjustment roller, and the second pitch adjustment roller is connected to a drive shaft that drives the second pitch adjustment roller via a one-way clutch that allows the second pitch adjustment roller to be rotated only in the direction following a sheet conveying direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
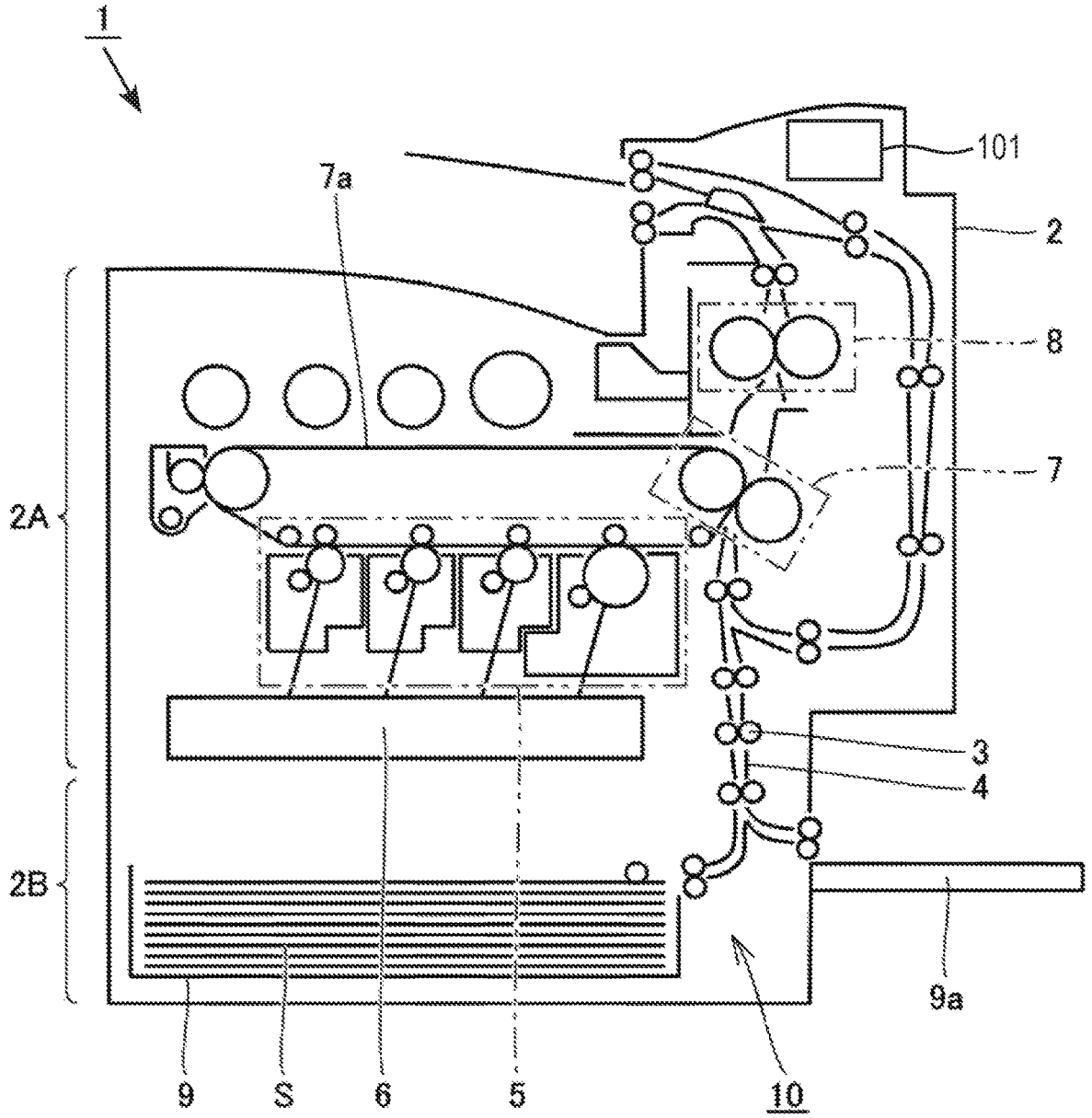
FIG. 1 is a schematic view of an image forming apparatus according to an embodiment of the present invention.

Hereinafter, one or more embodiments of the present invention will be described in detail with reference to the drawings. However, the scope of the invention is not limited to the disclosed embodiments. In the embodiments described below, as an image forming apparatus and a sheet conveyance device to winch the present invention is applied, a so-called tandem color printer adopting an electrophotographic system and a sheet conveyance device provided in the tandem color printer will be described as examples. Note that, in the following embodiments, the same or common parts are denoted by the same reference numerals in the drawings, and description thereof is not repeated.

FIG. 1 is a schematic view of an image forming apparatus according to an embodiment of the present invention; First, a schematic configuration of an image forming apparatus 1 according to the present embodiment will be described with reference to FIG. 1.

As illustrated in FIG. 1, the image forming apparatus 1 mainly includes an apparatus main body 2 and a supply tray 9 as a container. The apparatus main body 2 includes an image forming section 2A that is a part for forming an image on a sheet S made of a paper or the like as a recording material, and a sheet supply section 2B that is a part for supplying the sheet S to the image forming section 2A, and a CPU 101. The supply tray 9 accommodates the sheets S to be supplied to the image forming section 2A in a loading manner, and is detachably provided in the sheet supply section 2B.

In the interior of the image forming apparatus 1, various rollers 3 and guides 4 are installed across the above-described image forming section 2A and sheet supply section 2B, thereby to construct a conveyance path on which the sheet S is conveyed along a predetermined direction. As illustrated in FIG. 1, a manual feed tray 9*a* for supplying the sheet S to the image forming section 2A may be separately provided to the sheet supply section 2B.

Here, in the image forming apparatus 1, a sheet conveyance device 10 in the present embodiment, which will be described below, is mainly constituted by the supply tray 9 and the above-described various rollers 3 and guides 4.

The image forming section 2A mainly includes, for example, an image forming unit 5 capable of forming toner images of respective colors of yellow (Y), magenta (M), cyan (C), ad black (K), an exposure unit 6 for exposing photoreceptors included in the image forming unit 5, an intermediate transfer belt 7*a* suspended over the image forming unit 5, a transfer section 7 provided on the conveyance path and on a running path of the intermediate transfer belt 7*a*, a fixing device 8 provided on a portion on the conveyance path downstream of the transfer section 7.

The image forming unit 5 receives exposure from the exposure unit 6 and forms toner images of the respective colors of yellow (Y), magenta (M), cyan (C), and black (K) or a toner image constituted only of black (K), and transfers the toner images onto the intermediate transfer belt 7*a* (so-called primary transfer). As a result, a color toner image or a monochrome toner image is formed on the intermediate transfer belt 7*a*.

The intermediate transfer belt 7*a* conveys the color toner image or the monochrome toner image formed on the surface to the transfer section 7 and is in pressure contact with the transfer section 7 together with the sheet S conveyed from the sheet supply section 2B to the transfer section 7. As a result, the color toner image or the monochrome toner image formed on the surface of the intermediate transfer belt 7*a* is transferred to the sheet S (so-called secondary transfer).

The sheet S to which the color toner image or the monochrome toner image has been transferred is then pressurized and heated by the fixing device 8. As a result, a color image or a monochrome image is formed on the sheet S, and the sheet S on which the color image or the monochrome image is formed is then discharged from the apparatus main body 2.

Figure 2:
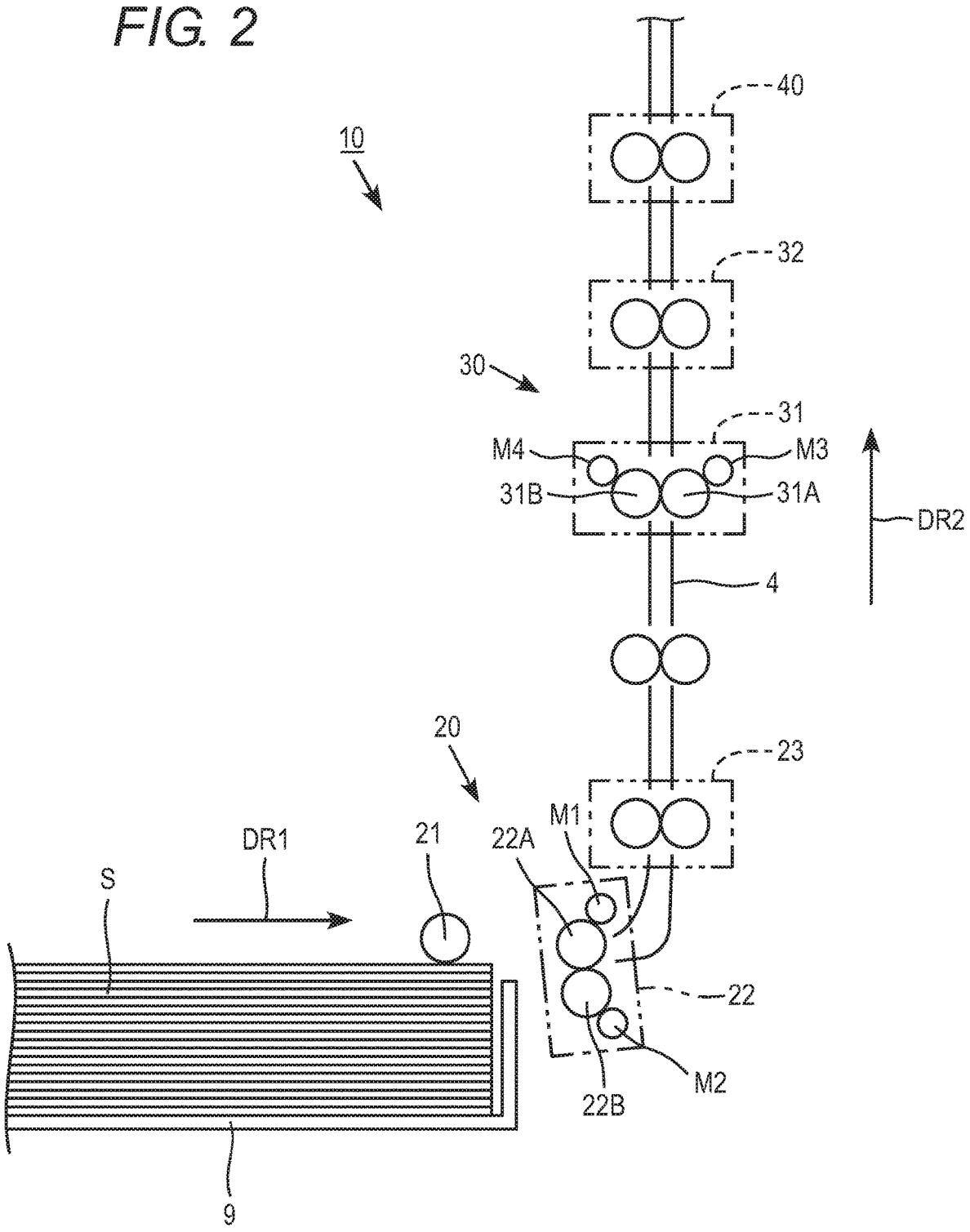
FIG. 2 is a view schematically illustrating a configuration of a sheet conveyance device according to an embodiment of the present invention.
Figure 3A:
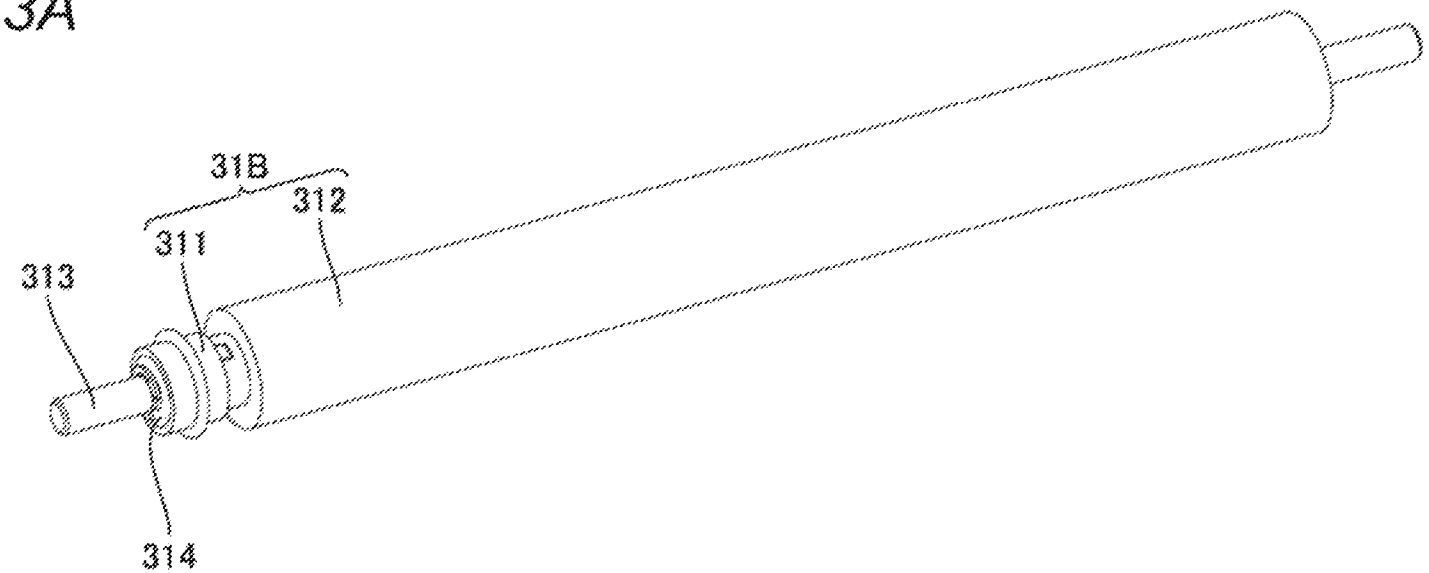
FIGS. 3A and 3B are a perspective view and a sectional view of a second pitch adjustment roller illustrated in FIG. 2.
Figure 3B:
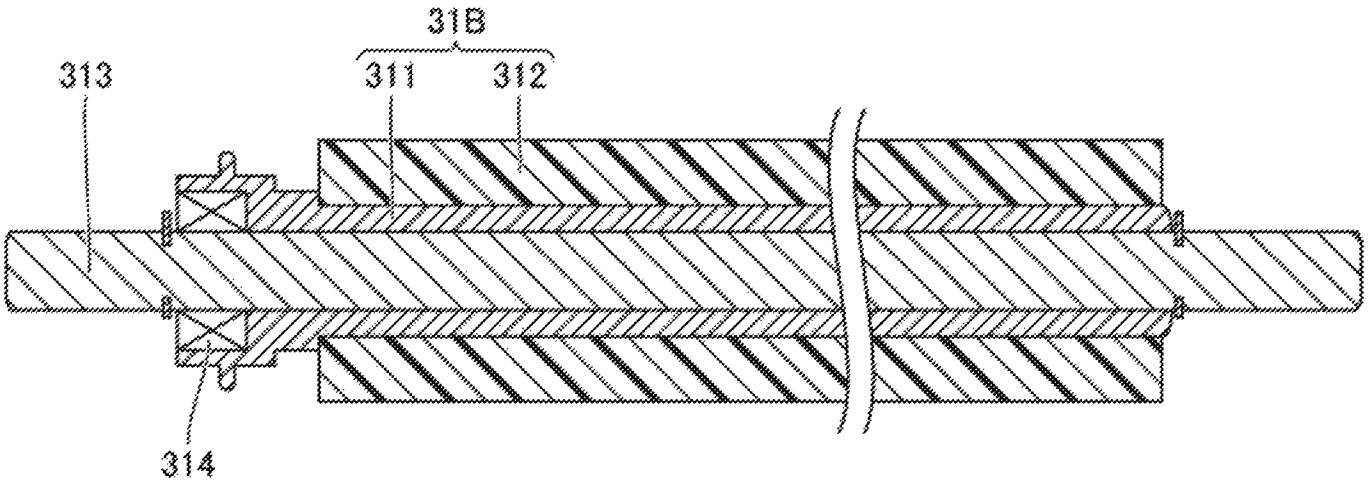

FIG. 2 is a view schematically illustrating a configuration of the sheet conveyance device according to the present embodiment and FIGS. 3A and 3B are a perspective view and a sectional view of a second pitch adjustment roller illustrated in FIG. 2. Next, the configuration of the sheet conveyance device 10 according to the present embodiment will be described in detail with reference to FIGS. 2, and 3A and 3B.

As illustrated in FIG. 2, the sheet conveyance device 10 mainly includes a supply tray 9 as the aforementioned container that accommodates a plurality of loaded sheets S, a feeding mechanism 20 that continuously feeds the sheets S from the supply tray 9, a conveyance path on which the sheet S fed by the feeding mechanism 20 is conveyed, a pitch adjustment mechanism 30 that adjusts a pitch of the sheets S conveyed on the conveyance path, a resist roller pair 40 that supplies the sheet S conveyed on the conveyance path to the transfer section 7 (see FIG. 1) at predetermined timing.

The supply tray 9 accommodates a plurality of the sheets S in an up-down direction as a loading direction. That is, the plurality of sheets S accommodated in the supply tray 9 is arranged in the supply tray 9 such that surfaces thereof on which an image is to be formed face upward and downward.

The feeding mechanism 20 includes a pickup roller 21, a separation roller pair 22 arranged downstream of the pickup roller 21 in the sheet conveying direction, a conveyance roller pair 23 arranged downstream of the separation roller pair 22 in the sheet conveying direction.

The pickup roller 21 is in pressure contact with the sheet located at an endmost position (that is, an uppermost position) in the loading direction of the plurality of loaded sheets S. The pickup roller 21 is driven and rotated in a predetermined direction (see FIGS. 5A and 5B) by a drive motor or the like (not illustrated) such that the sheet in contact with the pickup roller 21 is taken out of the supply tray 9 toward an arrow DR1 direction illustrated in FIG. 2.

The separation roller pair 22 includes a sending roller 22A and a handling roller 22B arranged to sandwich the conveyance path. The separation roller pair 22 makes the sheets S taken out of the supply tray 9 by the pickup roller 21 be in a separated state in the sheet conveying direction.

More specifically, in a case where the number of sheets S taken out by the pickup roller 21 is one, the separation roller pair 22 sends the one sheet as it is, and in a case where the number of sheets S taken out by the pickup roller 21 is two or more, the pickup roller 21 prevents extra sheets from being sent out.

The sending roller 22A is driven and rotated in a direction following the sheet conveying direction (see FIGS. 5A and 5B) by a drive motor M1 and the like (illustrated schematically). Meanwhile, the handling roller 22B is driven and rotated in a reverse direction to the direction following the sheet conveying direction by a drive motor M2 and the like (illustrated schematically).

As a result, the sending roller 22A sends out the sheet taken out of the supply tray 9 by the pickup roller 21 to the conveyance path, and the handling roller 22B generates conveyance resistance against the above-described extra sheet, thereby to prevent the sheet from being sent out by the sending roller 22A. Note that the sending roller 22A is arranged above the handling roller 22B.

The conveyance roller pair 23 is arranged to sandwich the conveyance path. The pair of rollers constituting the conveyance roller pair 23 is in pressure contact with each other by a biasing means (not illustrated). The conveyance roller pair 23 further sends out the sheet S sent out by the sending roller 22A to the conveyance path.

One roller of the pair of rollers constituting the conveyance roller pair 23 is driven and rotated in a direction following the sheet conveying direction (see FIGS. 5A and 5B) by a drive motor and the like (not illustrated) and the other roller is rotated following in the direction following the sheet conveying direction (see FIGS. 5A and 5B) by being in contact with the one roller.

Note that, in the conveyance path at a position where the feeding mechanism 20 is provided, a traveling direction of the sheet S is changed by a guide 4 and the like installed at the position, and the sheet S is fed in an arrow DR2 direction illustrated in FIG. 2. Thereafter, the conveying direction of the sheet S is the arrow DR2 direction illustrated in FIG. 2.

Here, the feeding mechanism 20 is able to feed out the preceding sheet and the subsequent sheet to the conveyance path in a partially overlapping state. Details of which will be described below.

The pitch adjustment mechanism 30 includes a pitch adjustment roller pair 31 arranged downstream of the conveyance roller pair 23 in the sheet conveying direction, and an auxiliary pitch adjustment roller pair 32 arranged downstream of the pitch adjustment roller pair 31 in the sheet conveying direction.

The pitch adjustment roller pair 31 includes a first pitch adjustment roller 31A and a second pitch adjustment roller 31B arranged to sandwich the conveyance path. The first pitch adjustment roller 31A and the second pitch adjustment roller 31B are in pressure contact with each other by biasing means (not illustrated).

The first pitch adjustment roller 31A is driven and rotated in the direction following the sheet conveying direction (see FIGS. 2 6A to 6C and FIGS. 7A to 7C) by a drive motor M3 and the like (illustrated schematically). Meanwhile, the second pitch adjustment roller 31B is also driven and rotated in the direction following the sheet conveying direction (see FIGS. 2 6A to 6C and FIGS. 7A to 7C) by a drive motor M4 and the like (illustrated schematically).

The auxiliary pitch adjustment roller pair 32 is arranged to sandwich the conveyance path. The pair of rollers constituting the auxiliary pitch adjustment roller pair 32 is in pressure contact with each other by biasing means (not illustrated).

One roller of the pair of rollers constituting the auxiliary pitch adjustment roller pair 32 is driven and rotated in the direction following the sheet conveying direction (see FIGS. 6A to 6C and FIGS. 7A to 7C) by a drive motor and the like (not illustrated) and the other roller is rotated following in the direction following the sheet conveying direction (see FIGS. 6A to 6C and FIGS. 7A to 7C) by being in contact with the one roller.

Here, the pitch adjustment roller pair 31 decreases an overlapping amount by adjusting the pitch between the preceding sheet and the subsequent sheet in a partially overlapping state, and the auxiliary pitch adjustment roller pair 32 further adjusts the pitch between the preceding sheet and the subsequent sheet in a state where the overlapping amount is decreased to form a gap having a predetermined size between the preceding sheet and the subsequent sheet. Details will be described below.

The resist roller pair 40 is arranged downstream of the auxiliary pitch adjustment roller pair 32 in the sheet conveying direction. The resist roller pair 40 is arranged to sandwich the conveyance path, and the pair of rollers constituting the resist roller pair 40 is in pressure contact with each other by biasing means (not illustrated). The resist roller pair 40 supplies the sheet S conveyed on the conveyance path to the transfer section 7 at predetermined timing.

One roller of the pair of rollers constituting the resist roller pair 40 is driven and rotated in the direction following the sheet conveying direction by a drive motor and the like (not illustrated) and the other roller is rotated following in the direction following the sheet conveying direction by being in contact with the one roller.

Note that the various rollers included in the feeding mechanism 20, the pitch adjustment mechanism 30, and the resist roller pair 40 described above need to be arranged with a smaller interval than a minimum length in lengths along the conveying direction of the conveyed sheet S (that is, a length along the conveying direction that is the minimum length in the conveying direction, in lengths in the sheet conveying direction in a case where a plurality of types of sheets having different sizes is conveyed). With this configuration, an individual sheet S does not stay on the conveyance path of the sheet conveyance device 10, and a plurality of the sheets S can be continuously conveyed.

In addition, the various rollers included in the feeding mechanism 20, the pitch adjustment mechanism 30, and the resist roller pair 40 described above may be driven by motive power of single driving means (for example, the above-described drive motor or the like) in a distributed manner, or may be driven by a plurality of driving means (for example, a plurality of the drive motors or the like) so that a part or all of the various rollers are individually driven.

Here, in the sheet conveyance device 10 according to the present embodiment, the conveyance roller pair 23 is driven and rotated in the direction following the sheet conveying direction such that a peripheral speed on an outer peripheral surface of the conveyance roller pair 23 becomes slower than a peripheral speed on an outer peripheral surface of the sending roller 22A.

Further, in the sheet conveyance device 10 according to the present embodiment, the second pitch adjustment roller 31B is driven and rotated in the direction following the sheet conveying direction such that a peripheral speed on an outer peripheral surface of the second pitch adjustment roller 31B becomes slower than a peripheral speed on an outer peripheral surface of the first pitch adjustment roller 31A.

Further, in the sheet conveyance device 10 according to the present embodiment, the auxiliary pitch adjustment roller pair 32 is driven and rotated in the direction following the sheet conveying direction such that a peripheral speed on an outer peripheral surface of the auxiliary pitch adjustment roller pair 32 becomes faster than a peripheral speed on an outer peripheral surface of the first pitch adjustment roller 31A.

Further, as illustrated in FIGS. 3A and 3B, in the sheet conveyance device 10 according to the present embodiment, the second pitch adjustment roller 31B is connected to a drive shaft 313 that drives the second pitch adjustment roller 31B via a one-way clutch 314 that allows the second pitch adjustment roller 31B to be rotated only in the direction following the sheet conveying direction.

Specifically, the second pitch adjustment roller 31B includes a metal or resin-made base 311 inserted onto the drive shaft 313 and rotatably supported by the drive shaft 313, and a rubber-made elastic layer 312 formed to cover the outer peripheral surface of the base 311, and the base 311 and the drive shaft 313 are connected via the one-way clutch 314. As a result, the second pitch adjustment roller 31B is allowed to be rotated only in the direction following the sheet conveying direction.

With the above configuration, in the sheet conveyance device 10 according to the present embodiment, the plurality of sheets S loaded in the supply tray 9 is fed in the state where the preceding sheet and the subsequent sheet partially overlap with each other by the feeding mechanism 20, the pitch between the preceding sheet and the subsequent sheet in the partially overlapping state is adjusted by the pitch adjustment mechanism 30 provided on the conveyance path, as a result, the gap having a predetermined size is formed between the preceding sheet and the subsequent sheet, and then the sheet S is supplied to the transfer section 7 by the resist roller pair 40. This point will be described in detail below.

Figure 4A:
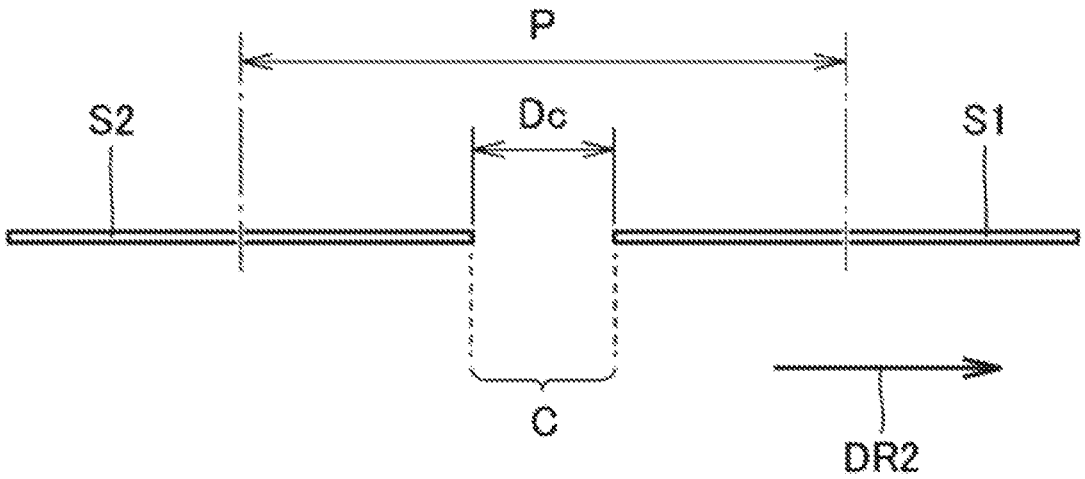
FIGS. 4A and 4B are views for describing a pitch, an overlap region, and a gap of a preceding sheet and a subsequent sheet.
Figure 4B:
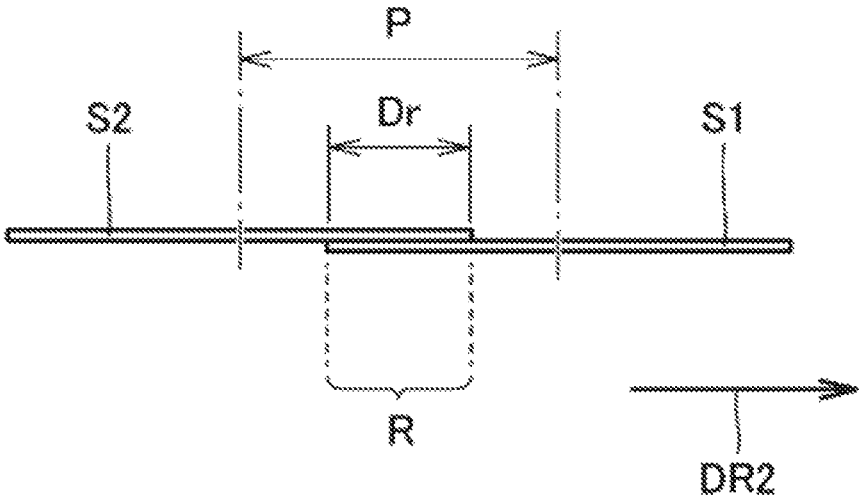

FIGS. 4A and 4B are views for describing a pitch, an overlap region, and a gap of a preceding sheet and a subsequent sheet. First, a pitch P, an overlapping region R, and a gap C between a preceding sheet S1 and a subsequent sheet S2 will be specifically described with reference to FIGS. 4A and 4B on the assumption that the preceding sheet S1 and the subsequent sheet S2 have the same size.

As illustrated in FIGS. 4A and 4B, the pitch P between the preceding sheet S1 and the subsequent sheet S2 is defined by a distance between a center position of the preceding sheet S1 in the sheet conveying direction DR2 and a center position of the subsequent sheet S2 in the sheet conveying direction DR2.

In a case where the pitch P between the preceding sheet S1 and the subsequent sheet S2 is larger than the length of the preceding sheet S1 and the subsequent sheet S2 in the sheet conveying direction DR2, the gap C is formed between a tail end of the preceding sheet S1 and a lead end of the subsequent sheet S2, as illustrated in FIG. 4A. In this case, the size of the gap C between the preceding sheet S and the subsequent sheet S2 is defined by a distance Dc between the tail end of the preceding sheet S1 and the lead end of the subsequent sheet S2.

Meanwhile, in a case where the pitch P between the preceding sheet S1 and the subsequent sheet S2 is smaller than the length of the preceding sheet S11 and the subsequent sheet S2 in the sheet conveying direction DR2, the tail end of the preceding sheet S1 and the lead end of the subsequent sheet S2 are in an overlapping state, as illustrated in FIG. 4B, and thus the overlapping region R is formed. In this case, the size of the overlapping region R between the preceding sheet S1 and the subsequent sheet S2 is defined by a distance Dr between the tail end of the preceding sheet S1 and the lead end of the subsequent sheet S2.

Here, when the preceding sheet S1 and the subsequent sheet S2 are conveyed on the conveyance path to have the overlapping region R, the sheet conveyance efficiency is improved. However, when the preceding sheet S1 and the subsequent sheet S2 are conveyed to the transfer section 7 while keeping the overlapping region R, printing defects occur due to the overlapping state. Therefore, in this embodiment, before the preceding sheet S1 and the subsequent sheet S2 are conveyed to the transfer section 7, the pitch P between the preceding sheet S1 and the subsequent sheet S2 is adjusted by the pitch adjustment mechanism 30 to eliminate the overlapping region R and form the gap C illustrated in FIG. 4A.

Figure 5A:
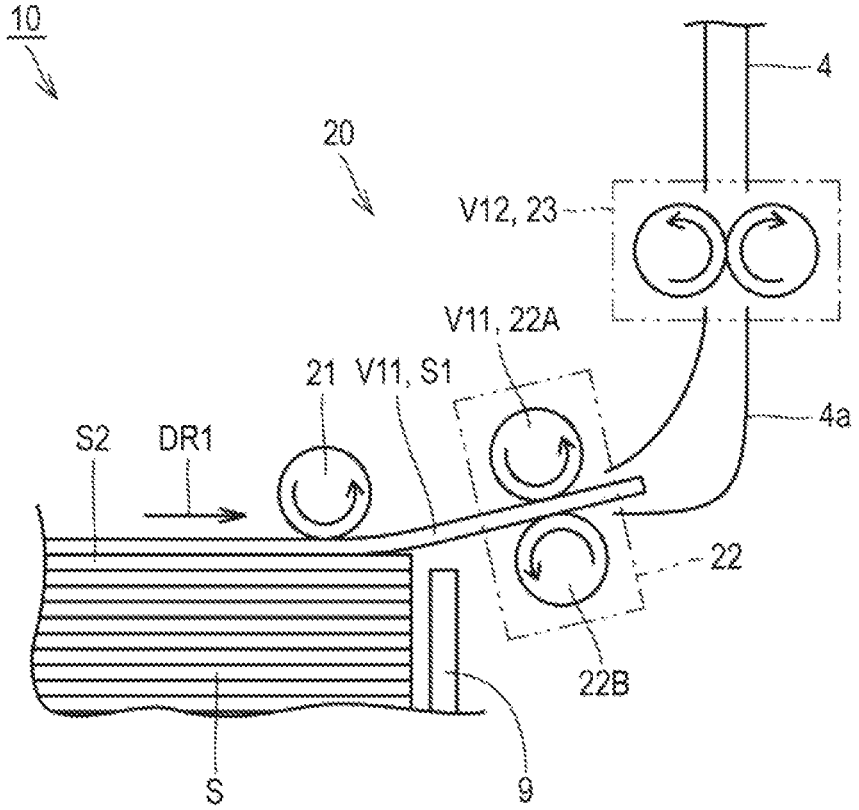
FIGS. 5A and 5B are views illustrating behaviors of a preceding sheet and a subsequent sheet in the vicinity of a feeding mechanism illustrated in FIG. 2.
Figure 5B:
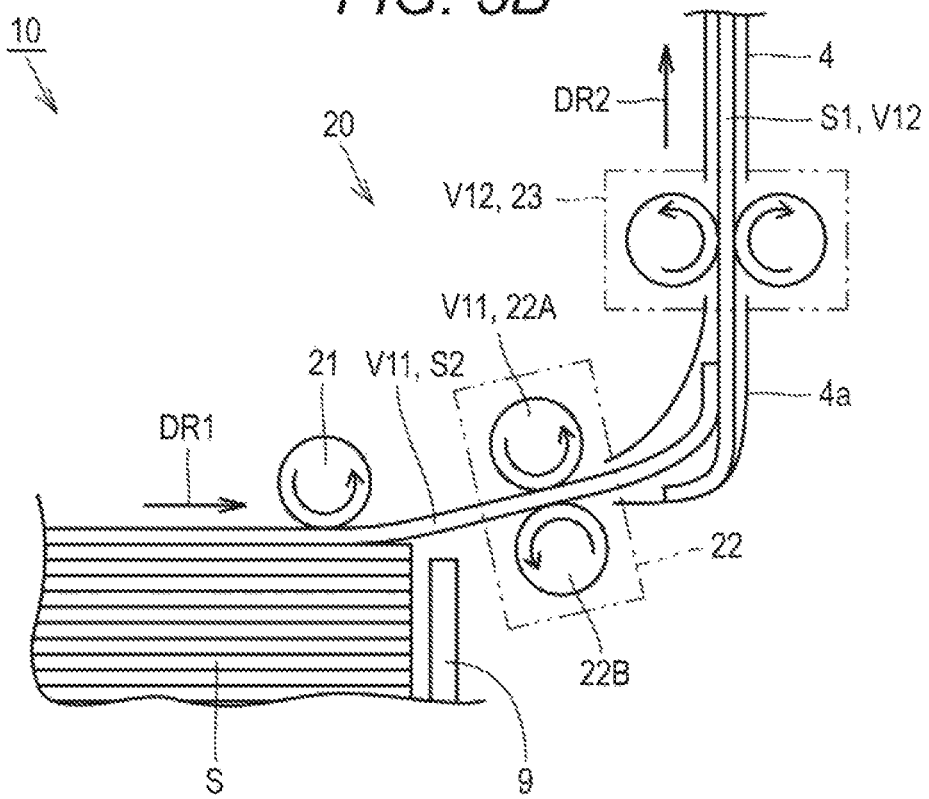

FIGS. 5A and 5B are views illustrating behaviors of a preceding sheet and a subsequent sheet in the vicinity of a feeding mechanism illustrated in FIG. 2. Next, behaviors of the preceding sheet S1 and the subsequent sheet S2 in the vicinity of the feeding mechanism 20 in the sheet conveyance device 10 in the present embodiment will be described in detail with reference to FIGS. SA and SB. In FIGS. 5A and 5B, the behaviors of the preceding sheet S1 and the subsequent sheet S2 in the vicinity of the feeding mechanism 20 are illustrated in chronological order, and the time has passed in order of FIG. 5A and FIG. 5B.

As described with reference to FIGS. 5A and 5B, in feeding the sheet S, the pickup roller 21, the sending roller 22A, and the conveyance roller pair 23 are driven and rotated in the direction following the sheet conveying direction, and the handling roller 22B is driven and rotated in the reverse direction to the direction following the sheet conveying direction.

Further, at that time, as described above, the conveyance roller pair 23 is driven and rotated such that the peripheral speed on the outer peripheral surface of the conveyance roller pair 23 becomes slower than the peripheral speed on the outer peripheral surface of the sending roller 22A. That is, a condition V11>V12 is satisfied, where the peripheral speed on the outer peripheral surface of the sending roller 22A is V11 and the peripheral speed on the outer peripheral surface of the conveyance roller pair 23 is V12.

In addition, a guide 4*a* located between the separation roller pair 22 and the conveyance roller pair 23, of the guide 4 constituting the conveyance path, is bent as illustrated in FIGS. 5A and 5B to change the sheet conveying direction at this portion. With the configuration the sheet conveying direction (roughly accords with the arrow DR1 direction illustrated in FIG. 5B) at the position where the separation roller pair 22 is provided, and the sheet conveying direction (the arrow DR2 direction illustrated in FIG. 5B) at the position where the conveyance roller pair 23 is provided intersect with each other as viewed along a direction parallel to an axial direction of the sending roller 22A.

Here, as illustrated in FIG. 5A, in feeding the sheet S, first, when the preceding sheet S1 sent out from the supply tray 9 by the pickup roller 21 enters the separation roller pair 22, the preceding sheet S1 is conveyed in the sheet conveying direction at a speed equivalent to a peripheral speed V11 on the outer peripheral surface of the sending roller 22A.

After that, as illustrated in FIG. 5B, the preceding sheet S1 is moved along the guide 4*a* located between the separation roller pair 22 and the conveyance roller pair 23, enters the conveyance roller pair 23, and then passes through the separation roller pair 22. As a result, the preceding sheet S1 is conveyed in the sheet conveying direction at a speed equivalent to a peripheral speed V12 on the outer peripheral surface of the conveyance roller pair 23.

Meanwhile, as illustrated in FIG. 5B, the subsequent sheet S2 starts to be taken out by the pickup roller 21 at the point of time when the preceding sheet S1 has passed through the pickup roller 21, and then enters the separation roller pair 22. The subsequent sheet S2 having entered the separation roller pair 22 is conveyed in the sheet conveying direction at a speed equivalent to the peripheral speed V11 on the outer peripheral surface of the sending roller 22A.

As a result, a state in which the preceding sheet S1 is conveyed by the conveyance roller pair 23 and the subsequent sheet S2 is conveyed by the separation roller pair 22 occurs. In this state, a speed difference is caused between a conveyance speed of the preceding sheet S1 and a conveyance sheet of the subsequent sheet S2 Due to the speed difference, the tail end of the preceding sheet S1 and front end of the subsequent sheet S2 overlap between the separation roller pair 22 and the conveyance roller pair 23, and thus the overlapping region R is formed.

In this manner, in the sheet conveyance device 10 in the present embodiment, the plurality of sheets S loaded in the supply tray 9 is fed out by the feeding mechanism 20 in the state where the preceding sheet S1 and the subsequent sheet S2 partially overlap with each other. Note that, by configuring the feeding mechanism 20 and the guide 4 as described above, the subsequent sheet S2 always overlaps on the same side as viewed from the preceding sheet S1, the overlapping region R can be stably formed.

FIGS. 6A to 6C and 7A to 7C are views illustrating behaviors of a preceding sheet and a subsequent sheet in the vicinity of the pitch adjustment mechanism illustrated in FIG. 2. Next, behaviors of the preceding sheet S1 and the subsequent sheet S2 in the vicinity of the pitch adjustment mechanism 30 in the sheet conveyance device 10 in the present embodiment will be described in detail with reference to FIGS. 6A to 6C and FIGS. 7A to 7C. In FIGS. 6A to 6C and FIGS. 7A to 7C, the behaviors of the preceding sheet S1 and the subsequent sheet S2 in the vicinity of the pitch adjustment mechanism 30 are illustrated in chronological order, and the time has passed in order of FIGS. 6A, 6B, 6C, 7A, 7B, and 7C. Further, illustration of the guide 4 is omitted in FIGS. 6A to 6C and FIGS. 7A to 7C.

As described with reference to FIGS. 6A to 7C, in conveying the sheet S, both the first pitch adjustment roller 31A and the second pitch adjustment roller 31B constituting the pitch adjustment roller pair 31 are driven and rotated in the direction following the sheet conveying direction, and the auxiliary pitch adjustment roller pair 32 is rotated and driven in the direction following the sheet conveying direction. Further, an upstream-side roller pair 50 arranged upstream of the pitch adjustment roller pair 31 in the sheet conveying direction is rotated and driven in the direction following the sheet conveying direction.

Further, at that time, as described above, the second pitch adjustment roller 31B is driven and rotated such that the peripheral speed on the outer peripheral surface of the second pitch adjustment roller 31B becomes slower than the peripheral speed on the outer peripheral surface of the first pitch adjustment roller 31A. That is, a condition V1>V2 is satisfied, where the peripheral speed on the outer peripheral surface of the first pitch adjustment roller 31A is V1 and the peripheral speed on the outer peripheral surface of the second pitch adjustment roller 31B is V2.

Further, at that time, as described above, the auxiliary pitch adjustment roller pair 32 is driven and rotated such that the peripheral speed on the outer peripheral surface of the auxiliary pitch adjustment roller pair 32 becomes faster than the peripheral speed on the outer peripheral surface of the first pitch adjustment roller 31A. That is, a condition V3>V1 is satisfied, where the peripheral speed on the outer peripheral surface of the auxiliary pitch adjustment roller pair 32 is V3.

Note that a peripheral speed on an outer peripheral surface of the upstream-side roller pair 50 is not particularly limited. Here, assume that the peripheral speed is set to the same speed as the peripheral speed on the outer peripheral surface of the first pitch adjustment roller 31A. That is, the peripheral speed on the outer peripheral surface of the upstream-side roller pair 50 is V1.

In addition, as described above, the second pitch adjustment roller 31B is connected to the drive shaft 313 that drives the second pitch adjustment roller 31B via the one-way clutch 314 that allows the second pitch adjustment roller 31B to be rotated only in the direction following the sheet conveying direction (see FIGS. 3A and 3B).

As a result, the second pitch adjustment roller 31B is driven and rotated by the first pitch adjustment roller 31A having a faster rotating speed than the drive shaft 313 in the state of being in pressure contact with the first pitch adjustment roller 31A without via the sheet S (that is, the second pitch adjustment roller 31B is rotated following the direction following the sheet conveying direction by being in pressure contact with the first pitch adjustment roller 31A), and the peripheral speed on the outer peripheral surface of the second pitch adjustment roller 31B at that time becomes V1 that is the same as the peripheral speed on the outer peripheral surface of the first pitch adjustment roller 31A.

Further, the second pitch adjustment roller 31B is driven and rotated by the first pitch adjustment roller 31A having a faster rotating speed than the drive shaft 313 in the state of being in pressure contact with the first pitch adjustment roller 31A via one sheet S (that is, the second pitch adjustment roller 31B is rotated following the direction following the sheet conveying direction by being in pressure contact with the first pitch adjustment roller 31A via one sheet S), and the peripheral speed on the outer peripheral surface of the second pitch adjustment roller 31B at that time becomes V1 that is the same as the peripheral speed on the outer peripheral surface of the first pitch adjustment roller 31A. This is because the friction coefficient of the first pitch adjustment roller 31A with respect to the sheet S and the friction coefficient of the second pitch adjustment roller 31B with respect to the sheet S are sufficiently high.

Meanwhile, the second pitch adjustment roller 31B is driven and rotated by the drive shaft 313 in the state of being in pressure contact with the first pitch adjustment roller 31A via two sheets S, and the peripheral speed on the outer peripheral surface of the second pitch adjustment roller 31B becomes V2 that is slower than the peripheral speed on the outer peripheral surface of the first pitch adjustment roller 31A. This is because the friction coefficient between the two sheets S is extremely smaller than the friction coefficient of the first pitch adjustment roller 31A with respect to the sheet S and the friction coefficient of the second pitch adjustment roller 31B with respect to the sheet S, and slippage occurs between these two sheets S.

Figure 6A:
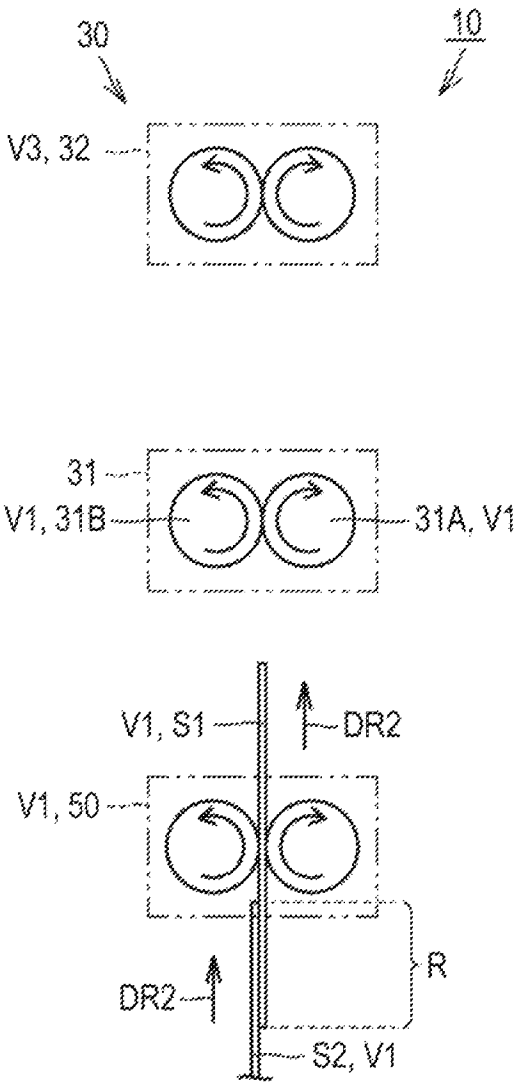
FIGS. 6A to 6C are views illustrating behaviors of a preceding sheet and a subsequent sheet in the vicinity of a pitch adjustment mechanism illustrated in FIG. 2.

Here, as illustrated in FIG. 6A, in conveying the preceding sheet S1 and the subsequent sheet S2 in the partially overlapping state, first, the preceding sheet S1 and the subsequent sheet S2 having entered the upstream-side roller pair 50 are conveyed in the sheet conveying direction at a speed equivalent to the peripheral speed V1 on the outer peripheral surface of the upstream-side roller pair 50.

Figure 6B:
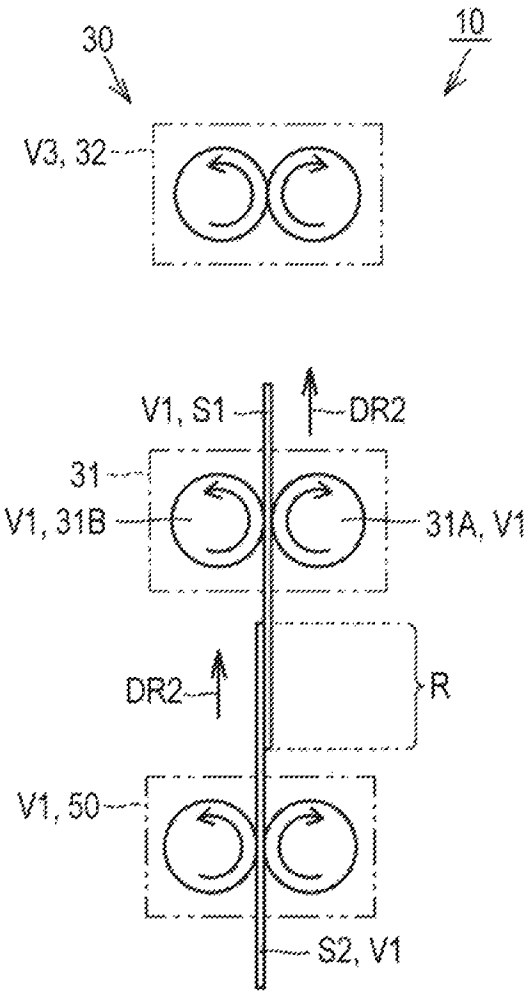

After that, as illustrated in FIG. 6B, when the preceding sheet S1 enters the pitch adjustment roller pair 31 and passes through the upstream-side roller pair 50, only one sheet S is arranged between the pitch adjustment roller pair 31. Therefore, the preceding sheet S1 is conveyed in the sheet conveying direction at a speed equivalent to the peripheral speed V1 on the outer peripheral surface of the pitch adjustment roller pair 31, and the subsequent sheet S2 is conveyed in the sheet conveying direction at a speed equivalent to the peripheral speed V1 on the outer peripheral surface of the upstream-side roller pair 50. In this state, since there is no speed difference between the preceding sheet S1 and the subsequent sheet S2, the size of the overlapping region R (that is, the distance Dr illustrated in FIG. 4B) is maintained without decreasing.

Figure 6C:
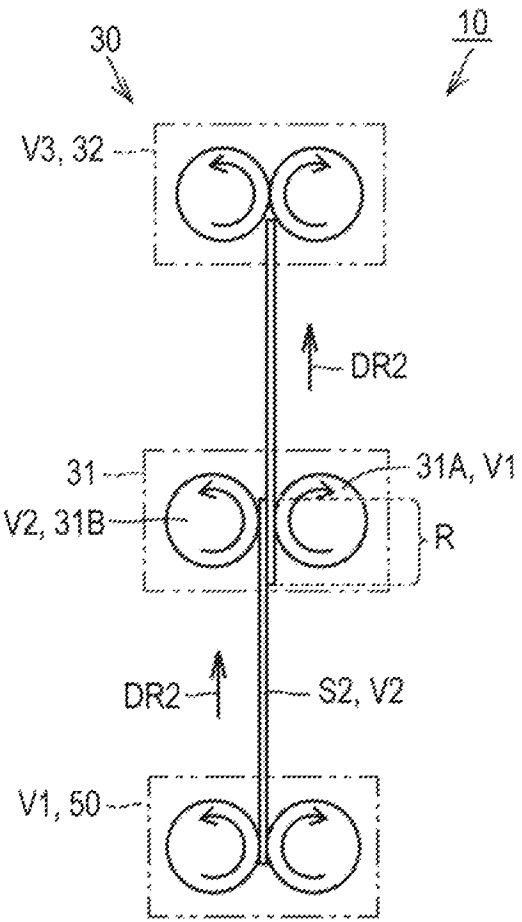

Further, after that, as illustrated in FIG. 6C, when the overlapping region R of the preceding sheet S1 and the subsequent sheet S2 enters the pitch adjustment roller pair 31, two sheets S are arranged between the pitch adjustment roller pair 31. Therefore, while the preceding sheet S1 is conveyed in the sheet conveying direction at a speed equivalent to the peripheral speed V1 on the outer peripheral surface of the first pitch adjustment roller 31A, the subsequent sheet S2 is conveyed in the sheet conveying direction at a speed equivalent to the peripheral speed V2 on the outer peripheral surface of the second pitch adjustment roller 31B. In this state, a speed difference occurs between the preceding sheet S1 and the subsequent sheet S2, and the size of the overlapping region R gradually decreases.

Figure 7A:
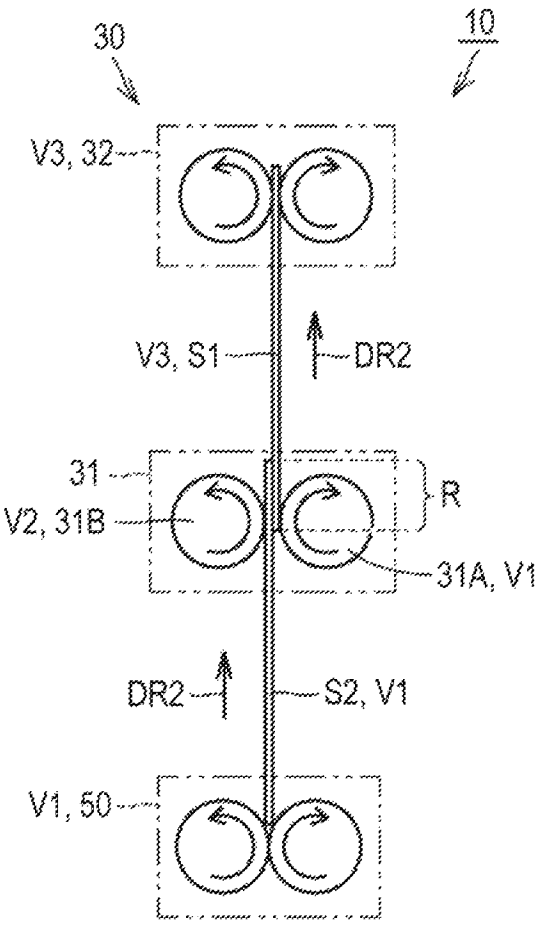
FIGS. 7A to 7C are views illustrating behaviors of a preceding sheet and a subsequent sheet in the vicinity of the pitch adjustment mechanism illustrated in FIG. 2.

Further, after that, as illustrated in FIG. 7A, when the preceding sheet S1 enters the auxiliary pitch adjustment roller pair 32, while the preceding sheet S1 is conveyed in the sheet conveying direction at a speed equivalent to a peripheral speed V3 on the outer peripheral surface of the auxiliary pitch adjustment roller pair 32, the subsequent sheet S2 is conveyed in the sheet conveying direction at the speed equivalent to the peripheral speed V2 on the outer peripheral surface of the second pitch adjustment roller 31B. Even in this state, the speed difference occurs between the preceding sheet S1 and the subsequent sheet S2, and the size of the overlapping region R gradually decreases.

Figure 7B:
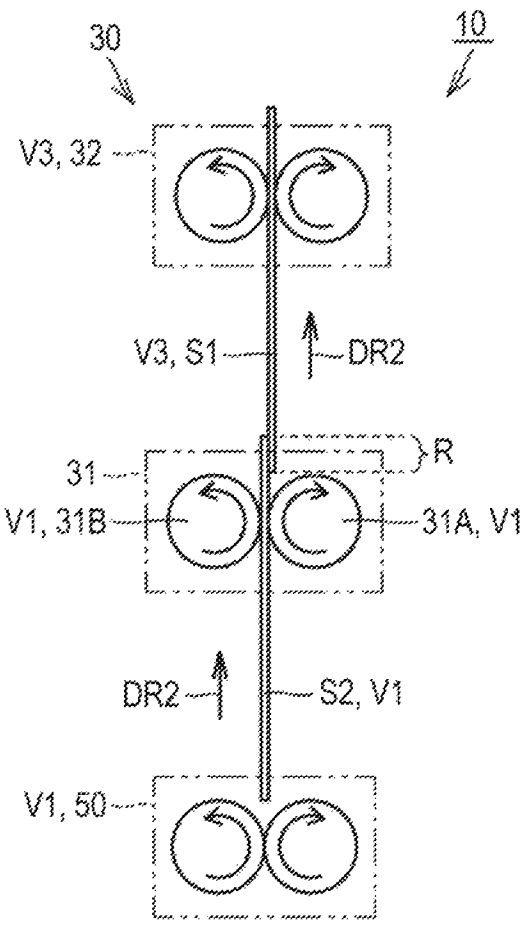

Further, after that, as illustrated in FIG. 7B, when the preceding sheet S1 passed through the pitch adjustment roller pair 31, only one sheet S is arranged between the pitch adjustment roller pair 31. Therefore, while the preceding sheet S1 is conveyed in the sheet conveying direction at a speed equivalent to the peripheral speed V3 on the outer peripheral surface of the auxiliary pitch adjustment roller pair 32, the subsequent sheet S2 is conveyed in the sheet conveying direction at a speed equivalent to the peripheral speed V1 on the outer peripheral surface of the pitch adjustment roller pair 31. Even in this state, the speed difference occurs between the preceding sheet S1 and the subsequent sheet S2, and the size of the overlapping region R gradually decreases.

Figure 7C:
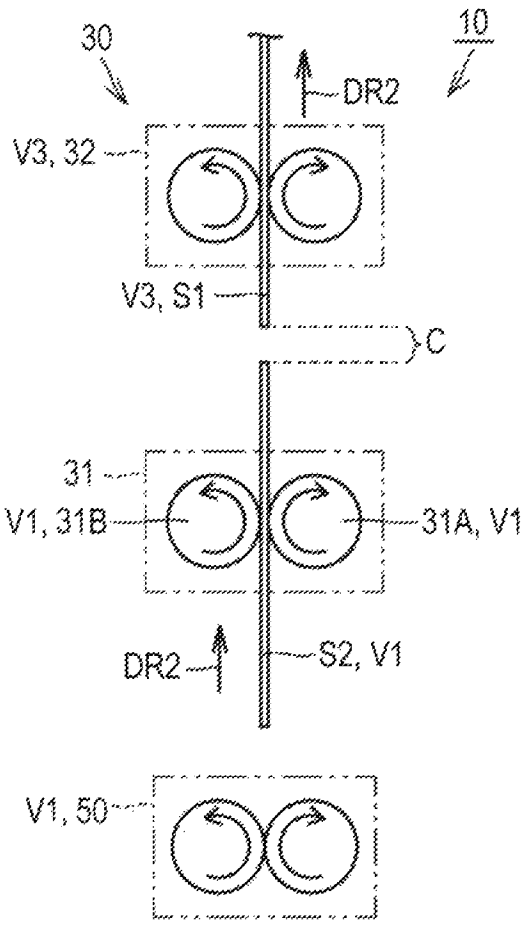

Further, after that, as illustrated in FIG. 7C, the overlapping region R of the preceding sheet S1 and the subsequent sheet S2 is canceled due to the speed difference between the preceding sheet S1 and the subsequent sheet S2, followed by the gap C formed between the preceding sheet S1 and the subsequent sheet S2. Note that the size of the gap C (that is, the distance Dc illustrated in FIG. 4A) gradually increases until the subsequent sheet S2 enters the auxiliary pitch adjustment roller pair 32.

As described above, according to the sheet conveyance device 10 and the image forming apparatus 1 including the same in the present embodiment, the plurality of sheets S loaded in the supply tray 9 is fed in the state where the preceding sheet S1 and the subsequent sheet S2 partially overlap with each other by the feeding mechanism 20, the pitch P between the preceding sheet S1 and the subsequent sheet S2 in the partially overlapping state is adjusted by the pitch adjustment mechanism 30 provided on the conveyance path, whereby, the gap having a predetermined size is formed between the preceding sheet S1 and the subsequent sheet S2, and then the sheet S is supplied to the transfer section 7 by the resist roller pair 40.

At that time, since the rotation of any of the rollers including the pitch adjustment roller pair 31 is not stopped, occurrence of variation in the conveyance speed due to backlash of a gear connecting the roller and the drive motor can be suppressed, and the conveyance speed of the sheet can be stabilized without providing a complicated control mechanism.

Therefore, by adopting this configuration, the productivity can be improved without increasing a system speed with a simple configuration without complicated control, and the sheet conveyance efficiency can be improved in the sheet conveyance device 10, and the image forming efficiency can be improved in the image forming apparatus 1.

Further, by adopting the above configuration, the preceding sheet S1 and the subsequent sheet S2 can be conveyed in the partially overlapping state on the conveyance path up to the pitch adjustment mechanism 30. Therefore, by appropriately adjusting the overlapping amount, the productivity can be greatly enhanced, as compared with a case of feeding the sheets in a so-called continuous feed state where no gap is formed between the tail end of the preceding sheet and the lead end of the subsequent sheet.

Here, to ensure the behaviors of the preceding sheet S1 and the subsequent sheet S2 in the vicinity of the pitch adjustment mechanism 30 described above, it is favorable that the friction coefficient of the first pitch adjustment roller 31A with respect to the sheet S be larger than the friction coefficient of the second pitch adjustment roller 31B with respect to the sheet S. With this configuration, the sheet S can be more reliably conveyed in the sheet conveying direction at the speed equivalent to the peripheral speed V1 on the outer peripheral surface of the first pitch adjustment roller 3A in the state where one sheet S is arranged between the pitch adjustment roller pair 31 (that is, in the states illustrated in FIGS. 6B, 7B, and 7C).

Further, to ensure the behaviors of the preceding sheet S1 and the subsequent sheet S2 in the vicinity of the pitch adjustment mechanism 30 described above, it is favorable that the friction coefficient of the auxiliary pitch adjustment roller pair 32 with respect to the sheet S be larger than the friction coefficient of the first pitch adjustment roller 31A with respect to the sheet S. With this configuration, the sheet S can be more reliably conveyed in the sheet conveying direction at the speed equivalent to the peripheral speed V3 on the outer peripheral surface of the auxiliary pitch adjustment roller pair 32 in the state where one sheet S is arranged across the pitch adjustment roller pair 31 and the auxiliary pitch adjustment roller pair 32 (that is, in the state illustrated in FIG. 7B).

Note that the above-described peripheral speed on the outer peripheral surface of each roller (that is, the radius and the rotating sheet of each roller) may just be appropriately determined according to the size of the sheet to be conveyed, the overlapping amount in a case where the preceding sheet and the subsequent sheet are brought to overlap with each other, and the size of the gap formed between the preceding sheet and the subsequent sheet.

The configuration of the conveyance path described in the embodiment of the present invention (that is, the numbers and arrangement positions of the roller pairs, and the numbers, shapes, and arrangement positions of the guides installed on the conveyance path, and the like) can be appropriately changed as long as without departing from the gist of the present invention.

Further, in the above-described embodiment of the present invention the case of causing the conveyance resistance against the sheet by driving and rotating the handling roller in the reverse direction to the direction following the sheet conveying direction has been described. However, the handling roller is not necessarily driven and rotated in the reverse direction. The conveyance resistance against the sheet may be caused by stopping the rotation of the handling roller, thereby to prevent extra sheet from being sent out by the sending roller.

In the above-described embodiment of the present invention, the case of applying the present invention to the so-called tandem color printer adopting an electrophotographic system and the sheet conveyance device provided in the color printer has been described. However, the application target of the present invention is not limited thereto, and the present invention can be applied to various sheet conveyance devices and image forming apparatuses.

Although embodiments of the present invention have been described and illustrated in detail, the disclosed embodiments are made for purposes of illustration and example only and not limitation. The scope of the present invention should be interpreted by terms of the appended claims and include all modification within the meaning and scope equivalent to the description of the claims.

What is claimed is:

1. A sheet conveyance device comprising:

a container that accommodates a plurality of loaded sheets;

a feeding mechanism that continuously feeds the sheet from the container;

a conveyance path on which the sheet fed by the feeding mechanism is conveyed; and a pitch adjustment mechanism provided on the conveyance path and which adjusts a pitch of a preceding sheet and a subsequent sheet in an at least partially overlapping state, wherein the pitch adjustment mechanism includes a pitch adjustment roller pair including a first pitch adjustment roller and a second pitch adjustment roller that sandwich the conveyance path and are in pressure contact with each other, the first pitch adjustment roller is driven by a first drive motor and rotated in a direction following a sheet conveying direction, the second pitch adjustment roller is driven by a second drive motor and rotated in the direction following the sheet conveying direction such that a peripheral speed on an outer peripheral surface of the second pitch adjustment roller becomes slower than a peripheral speed on an outer peripheral surface of the first pitch adjustment roller, and the second pitch adjustment roller is connected to a drive shaft that drives the second pitch adjustment roller via a one-way clutch that allows the second pitch adjustment roller to be rotated only in the direction following the sheet conveying direction.

2. The sheet conveyance device according to claim 1, wherein a friction coefficient of the first pitch adjustment roller to the sheet is larger than a friction coefficient of the second pitch adjustment roller to the sheet.

3. The sheet conveyance device according to claim 1, wherein the pitch adjustment mechanism further includes an auxiliary pitch adjustment roller pair arranged downstream of the pitch adjustment roller pair in the sheet conveying direction, and the auxiliary pitch adjustment roller pair is driven and rotated in the direction following a sheet conveying direction such that a peripheral speed on an outer peripheral surface of the auxiliary pitch adjustment pair rollers becomes faster than the peripheral speed on an outer peripheral surface of the first pitch adjustment roller.

4. The sheet conveyance device according to claim 3, wherein a friction coefficient of the auxiliary pitch adjustment roller pair to the sheet is larger than a friction coefficient of the first pitch adjustment roller to the sheet.

5. The sheet conveyance device according to claim 1, wherein the feeding mechanism is capable of feeding the preceding sheet and the subsequent sheet in an at least partially overlapping state.

6. The sheet conveyance device according to claim 5, wherein the feeding mechanism includes a pickup roller that takes out the sheet by being driven and rotated in a state of being in contact with the sheet located at an endmost position in a loading direction of the plurality of loaded sheets, a separation roller pair arranged downstream of the pickup roller in the sheet conveying direction, and arranged to sandwich the conveyance path, and a conveyance roller pair arranged downstream of the separation roller pair in the sheet conveying direction, the separation roller pair includes a sending roller that sends the sheet by being driven and rotated in the direction following the sheet conveying direction, and a handling roller that generates conveyance resistance against the sheet by being driven and rotated in a reverse direction to the direction following the sheet conveying direction or by being stopped to be rotated, and the conveyance roller pair is driven and rotated in the direction following the sheet conveying direction such that a peripheral speed on an outer peripheral surface of the conveyance roller pair becomes slower than a peripheral speed on an outer peripheral surface of the sending roller.

7. The sheet conveyance device according to claim 6, wherein the conveyance path is provided such that the sheet conveying direction at a position where the sending roller is provided and the sheet conveying direction at a position where the conveyance roller pair is provided intersect with each other as viewed along a direction parallel to an axial direction of the sending roller.

8. An image forming apparatus comprising the sheet conveyance device according to claim 1.

9. The sheet conveyance device according to claim 1, further comprising:

a separation roller pair arranged upstream of the pitch adjustment mechanism and arranged to sandwich the conveyance path.

10. The sheet conveyance device according to claim 1, wherein the peripheral speed of the outer peripheral surface of the second pitch adjustment roller and the peripheral speed of the outer peripheral surface of the first pitch adjustment roller eliminate overlap in sheets being conveyed along the conveyance path in a partially overlapping state.

11. A sheet conveyance device comprising:

a container that accommodates a plurality of loaded sheets;

a feeding mechanism that continuously feeds the sheet from the container;

a conveyance path on which the sheet fed by the feeding mechanism is conveyed;

a separation roller pair arranged downstream of the feeding mechanism and is arranged to sandwich the conveyance path;

a pitch adjustment mechanism provided on the conveyance path downstream of the separation roller pair and which includes a pitch adjustment roller pair including a first pitch adjustment roller and a second pitch adjustment roller that sandwich the conveyance path and are in pressure contact with each other; and a hardware processor configured to control the feeding mechanism, the separation roller pair, and the pitch adjustment mechanism;

wherein:

the pitch adjustment mechanism is configured to adjust a pitch of a preceding sheet and a subsequent sheet in an at least partially overlapping state;

the first pitch adjustment roller is driven by a first drive motor and rotated in a direction following a sheet conveying direction, the second pitch adjustment roller is driven by a second drive motor and rotated in the direction following the sheet conveying direction such that a peripheral speed on an outer peripheral surface of the second pitch adjustment roller becomes slower than a peripheral speed on an outer peripheral surface of the first pitch adjustment roller, and the second pitch adjustment roller is connected to a drive shaft that drives the second pitch adjustment roller via a one-way clutch that allows the second pitch adjustment roller to be rotated only in the direction following the sheet conveying direction.

12. The sheet conveyance device according to claim 11, the hardware processor controls the sheet conveyance device such that sheets are fed into the pitch adjustment mechanism in an overlapping state, and the pitch adjustment mechanism converts the state of the sheets to one with a gap between adjacent sheets.

13. The sheet conveyance device according to claim 11, further comprising a resist roller pair downstream of the pitch adjustment mechanism.

14. A sheet conveyance device comprising:

a container that accommodates a plurality of loaded sheets;

a feeding mechanism that continuously feeds the sheet from the container;

a conveyance path on which the sheet fed by the feeding mechanism is conveyed;

a separation roller pair arranged downstream of the feeding mechanism and is arranged to sandwich the conveyance path;

a pitch adjustment mechanism provided on the conveyance path downstream of the separation roller pair and which includes a pitch adjustment roller pair including a first pitch adjustment roller and a second pitch adjustment roller that sandwich the conveyance path and are in pressure contact with each other; and a hardware processor configured to control the feeding mechanism, the separation roller pair, and the pitch adjustment mechanism;

wherein:

the pitch adjustment mechanism is configured to adjust a pitch of a preceding sheet and a subsequent sheet in an at least partially overlapping state;

the first pitch adjustment roller is driven and rotated in a direction following a sheet conveying direction, the second pitch adjustment roller is driven and rotated in the direction following the sheet conveying direction such that a peripheral speed on an outer peripheral surface of the second pitch adjustment roller becomes slower than a peripheral speed on an outer peripheral surface of the first pitch adjustment roller, the second pitch adjustment roller is connected to a drive shaft that drives the second pitch adjustment roller via a one-way clutch that allows the second pitch adjustment roller to be rotated only in the direction following the sheet conveying direction; and the separation roller pair includes a sending roller that is driven and rotated in a direction following the sheet conveying direction by a first drive motor, and a handling roller that is driven and rotated in a reverse direction to the direction following the sheet conveying direction by a second drive motor.

* * * * *